US010657877B2

(12) United States Patent
Zhu et al.

(10) Patent No.: US 10,657,877 B2
(45) Date of Patent: May 19, 2020

(54) DRIVING CIRCUIT, DRIVING METHOD AND DISPLAY DEVICE

(71) Applicant: Shanghai Tianma AM-OLED Co., Ltd., Shanghai (CN)

(72) Inventors: Renyuan Zhu, Shanghai (CN); Yue Li, Shanghai (CN); Dongxu Xiang, Shanghai (CN); Yana Gao, Shanghai (CN); Xingyao Zhou, Shanghai (CN); Gaojun Huang, Shanghai (CN); Yilin Xu, Shanghai (CN); Zhonglan Cai, Shanghai (CN); Juan Zhu, Shanghai (CN)

(73) Assignee: SHANGHAI TIANMA AM-OLED CO., LTD., Shanghai (CN)

( * ) Notice: Subject to any disclaimer, the term of this patent is extended or adjusted under 35 U.S.C. 154(b) by 0 days.

(21) Appl. No.: 16/190,670

(22) Filed: Nov. 14, 2018

(65) Prior Publication Data

US 2019/0311669 A1 Oct. 10, 2019

(30) Foreign Application Priority Data

Apr. 10, 2018 (CN) ..... 2018 1 0315684

(51) Int. Cl.

| | |
|---|---|
| ***G09G 3/20*** | (2006.01) |
| *G09G 3/3266* | (2016.01) |
| *G09G 3/36* | (2006.01) |

(52) U.S. Cl.

CPC ..... *G09G 3/2092* (2013.01); *G09G 3/3266* (2013.01); *G09G 3/3677* (2013.01); *G09G 2310/0286* (2013.01); *G09G 2310/08* (2013.01)

(58) Field of Classification Search

CPC ..... G09G 3/2092; G09G 3/20; G09G 2310/0267; G09G 2310/0286; G09G 2310/08; G09G 3/3266; G09G 3/3677

See application file for complete search history.

(56) References Cited

U.S. PATENT DOCUMENTS

2011/0142191 A1* 6/2011 Tobita ..... G11C 19/184 377/64

FOREIGN PATENT DOCUMENTS

CN 103680397 A 3/2014

* cited by examiner

*Primary Examiner* — Towfiq Elahi
(74) *Attorney, Agent, or Firm* — Tarolli, Sundheim, Covell & Tummino LLP

(57) ABSTRACT

The present disclosure provides a driving circuit, a display device and a driving method. The driving circuit includes a shift register including: a first input unit for controlling a first node based on signals at first and second clock signal terminals, an input signal terminal, a second node and an output signal terminal; a second input unit for providing a signal at a first constant potential terminal to the second node under control of the first clock signal terminal and providing the signal at the input signal terminal or the first clock signal terminal to the second node under control of the first node; and an output unit for providing a signal at the second clock signal terminal to the output signal terminal under control of the first node and providing a signal at a second constant potential terminal to the output signal terminal under control of the second node.

18 Claims, 6 Drawing Sheets

DRIVING CIRCUIT, DRIVING METHOD AND DISPLAY DEVICE

CROSS-REFERENCE TO RELATED APPLICATIONS

The present application claims priority to Chinese Patent Application No. 201810315684.2, filed on Apr. 10, 2018, the content of which is incorporated herein by reference in its entirety.

TECHNICAL FIELD

The present disclosure relates to the field of display technologies, and particularly, to a driving circuit, a driving method and a display device.

BACKGROUND

In general, a display device includes a plurality of sub-pixels within a display panel and a driving circuit that drives the sub-pixels to emit light. The driving circuit typically consists of a plurality of cascaded shift registers. However, conventionally, when an output signal from a shift register fails to be switched between a high level and a low level timely, a potential at a control node within the shift register may be affected, which in turn results in an error in the output signal from the shift register and thus abnormal display of the display device.

SUMMARY

The present disclosure provides a driving circuit, a driving method and a display device.

In a first aspect of the present disclosure, a driving circuit is provided. The driving circuit includes one or more shift registers. Each of the one or more shift registers includes a first input unit configured to provide a signal at an input signal terminal to a first node under control of a first clock signal terminal; provide the signal at the input signal terminal to the first node under control of the first clock signal terminal and a second clock signal terminal; provide a signal at an output signal terminal to the first node under control of a second node and the second clock signal terminal; and provide the signal at the output signal terminal to the first node under control of the second node, the second clock signal terminal and the first clock signal terminal; a second input unit configured to provide a signal at a first constant potential terminal to the second node under control of the first clock signal terminal and provide the signal at the input signal terminal or a signal at the first clock signal terminal to the second node under control of the first node; and an output unit configured to provide a signal at the second clock signal terminal to the output signal terminal under control of the signal at the first node and provide a signal at a second constant potential terminal to the output signal terminal under control of the signal at the second node.

In a second aspect, a display device is provided. The display device includes the driving circuit as mentioned in the first aspect.

In a third aspect, a driving method is provided. The driving method is applied in the driving circuit as mentioned in the first aspect. The driving method includes: in a first phase, providing a first level signal to the input signal terminal, the first level signal to the first clock signal terminal and a second level signal to the second clock signal terminal, such that the second level signal is outputted at the output signal terminal; in a second phase, providing the second level signal to the input signal terminal, the second level signal to the first clock signal terminal and the first level signal to the second clock signal terminal, such that the first level signal is outputted at the output signal terminal; in a third phase, providing the second level signal to the input signal terminal, the first level signal to the first clock signal terminal and the second level signal to the second clock signal terminal, such that the second level signal is outputted at the output signal terminal; and in a fourth phase, providing the second level signal to the input signal terminal, the second level signal to the first clock signal terminal and the first level signal to the second clock signal terminal, such that the second level signal is outputted at the output signal terminal.

BRIEF DESCRIPTION OF DRAWINGS

In order to illustrate technical solutions of embodiments of the present disclosure, the accompanying drawings used in the embodiments or the prior art are introduced hereinafter. Obviously, these drawings illustrate some embodiments of the present disclosure. On the basis of these drawings, those skilled in the art can also obtain other drawings without paying any creative effort.

DESCRIPTION OF EMBODIMENTS

In order to better understand technical solutions of the present disclosure, the embodiments of the present disclosure are described in details with reference to the drawings.

It should be clear that the described embodiments are merely part of the embodiments of the present disclosure rather than all of the embodiments. All other embodiments obtained by those skilled in the art without paying creative labor shall fall into the protection scope of the present disclosure.

The terms used in the embodiments of the present disclosure are merely for the purpose of describing specific embodiments, rather than limiting the present disclosure. The singular form "a", "an", "the" and "said" used in the embodiments and claims shall be interpreted as also including the plural form, unless indicated otherwise in the context.

It should be understood that, the term "and/or" is used in the present disclosure merely to describe relations between associated objects, and thus includes three types of relations. That is, A and/or B can represent: (a) A exists alone; (b) A and B exist at the same time; or (c) B exists alone. In addition, the character "/" generally indicates "or".

Figure 1:
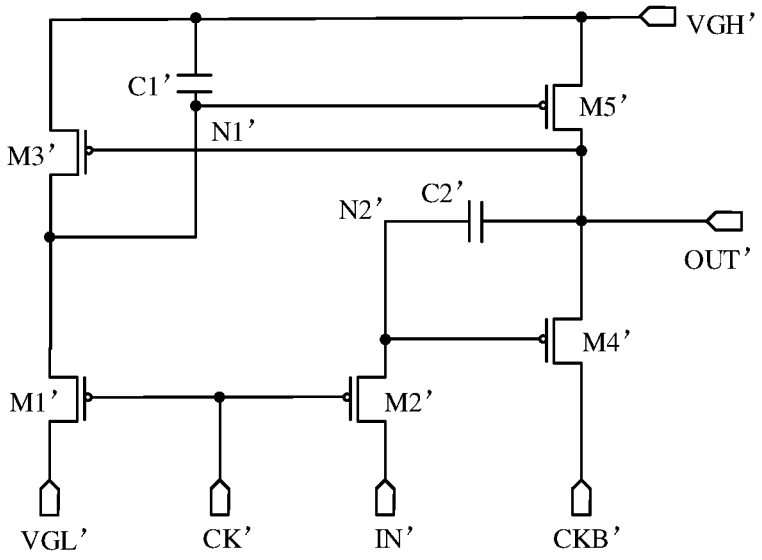
FIG. 1 (PRIOR ART)
FIG. 1 is a schematic diagram showing a circuit structure of a shift register in the prior art.
Figure 2:
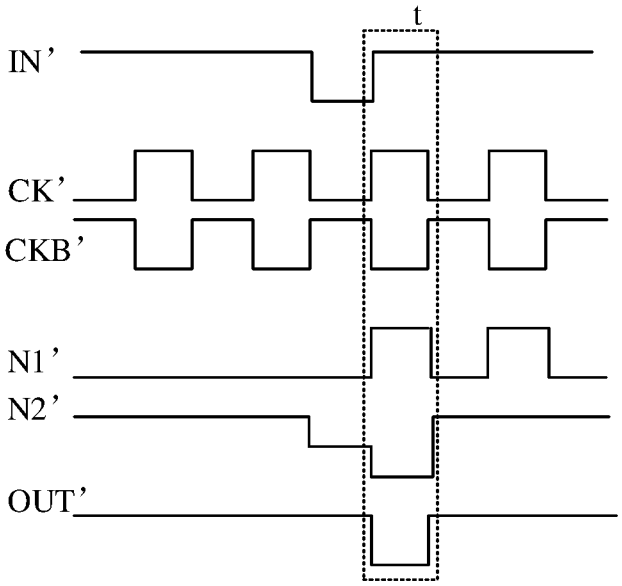
FIG. 2 (PRIOR ART)
FIG. 2 is a schematic diagram showing an operation timing sequence of the shift register in the prior art.

FIG. 1 is a schematic diagram showing an internal structure of a shift register in the prior art. FIG. 2 is a schematic diagram showing a driving timing sequence for the shift register shown in FIG. 1. As shown in FIGS. 1 and 2, an output terminal OUT' of the shift register is connected to a control terminal of a Thin Film Transistor (TFT) M3'. Thus, when the shift register operates normally, e.g., in a period t, when a low level is outputted at the output terminal OUT'. Due to feedback from the output terminal OUT', the TFT M3' is switched on under control of the low level and a potential at a first node N1' is set to be high by a high level signal VGH' via the TFT M3', such that a TFT M5' is switched off under control of the high level. In this case, a second node N2' is at a low level, which controls a TFT M4' to be on and a low level signal from a clock signal terminal CKB' to be written into the output terminal OUT', such that a low level is outputted at the output terminal OUT'.

However, due to the internal circuit structure of the shift register, the output terminal OUT' is connected to the control terminal of the TFT M3'. Thus, if the output signal from the output terminal OUT' fails to be switched from the high level to the low level timely, the output signal would not be set to low timely, such that the TFT M3' cannot be switched on timely and thus the potential at the first node N1' cannot be set to high timely. In this case, the TFT M5' and the TFT M4' could be on simultaneously, resulting in a contention risk for the output from the output terminal OUT' which may lead to an output error.

Figure 3:
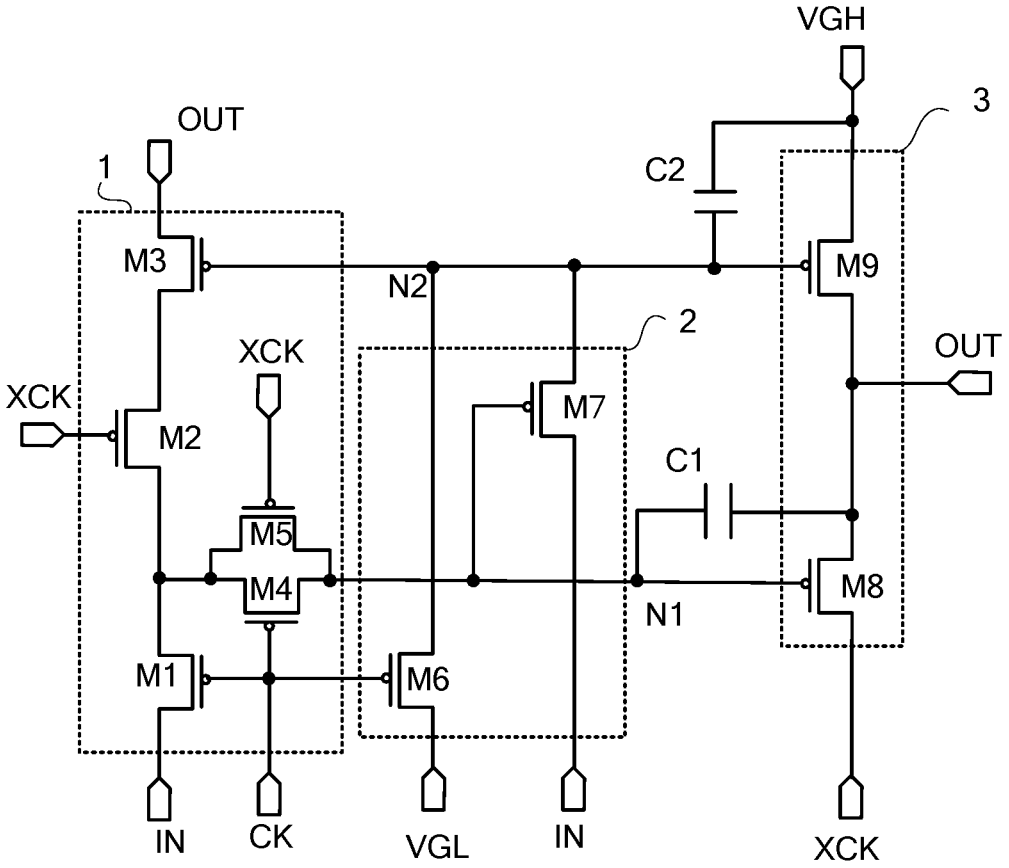
FIG. 3 is a schematic diagram showing a circuit structure of a shift register according to an embodiment of the present disclosure.

In view of the above, a shift register is provided according to an embodiment of the present disclosure. FIG. 3 is a schematic diagram showing an internal structure of a shift register according to an embodiment of the present disclosure. As shown in FIG. 3, the shift register includes a first input unit 1, a second input unit 2 and an output unit 3.

The first input unit 1 is configured to provide a signal at an input signal terminal IN to a first node N1 under control of a first clock signal terminal CK; provide the signal at the input signal terminal IN to the first node N1 under control of the first clock signal terminal CK and a second clock signal terminal XCK; provide a signal at an output signal terminal OUT to the first node N1 under control of a second node N2 and the second clock signal terminal XCK; and provide the signal at the output signal terminal OUT to the first node N1 under control of the second node N2, the second clock signal terminal XCK and the first clock signal terminal CK.0

The second input unit 2 is configured to provide a signal at a first constant potential terminal VGL to the second node N2 under control of the first clock signal terminal CK and provide the signal at the input signal terminal IN or the first clock signal terminal CK to the second node N2 under control of the first node N1.

The output unit 3 is configured to provide the signal at the second clock signal terminal SCK to the output signal terminal OUT under control of the signal at the first node N1 and provide a signal at a second constant potential terminal VGH to the output signal terminal OUT under control of the signal at the second node N2.

In the following, the operation process of the above shift register will be described in detail with reference to FIG. 3 and FIG. 4, which is an operation timing sequence diagram corresponding to FIG. 3. The operation process of the shift register includes a first phase t1, a second phase t2, a third phase t3 and a fourth phase t4.

In particular, in the first phase t1, the first input unit 1 provides a low level to the first node N1 based on a low level signal at the first clock signal terminal CK, a high level signal at the second clock signal terminal XCK and a low level signal at the input signal terminal IN. The second input unit 2 provides a low level to the second node N2 based on the low level signal at the first clock signal terminal CK, a low level signal at the first constant potential terminal VGL, the low level signal at the first node N1 and the low level signal at the input signal terminal IN. The output unit 3 causes the output signal terminal OUT to output a high level based on the high level signal at the second clock signal terminal XCK, the low level signal at the first node N1, the low level signal at the second node N2 and a high level signal at the second constant potential terminal VGH.

In the second phase t2, the first input unit 1 maintains the first node N1 at the low level in the first phase t1 based on a high level signal at the first clock signal terminal CK. The second input unit 2 provides a high level to the second node N2 based on a high level signal at the input signal terminal IN and the low level signal at the first node N1. The output unit 3 causes the output signal terminal OUT to output a low level based on a low level signal at the second clock signal terminal XCK and the low level signal at the first node N1.

In the third phase t3, the first input unit 1 provides a high level to the first node N1 based on a low level signal at the first clock signal terminal CK and a high level signal at the input signal terminal IN. The second input unit 2 provides a low level to the second node N2 based on the low level signal at the first clock signal terminal CK and the low level signal at the first constant potential terminal VGL. The output unit 3 causes the output signal terminal OUT to output a high level based on the low level signal at the second node N2 and the high level signal at the second constant potential terminal VGH.

In the fourth phase t4, the second input unit 2 maintains the second node N2 at the low level in the third phase t3 based on a high level signal at the first clock signal terminal CK. The output unit 3 causes the output signal terminal OUT to output a high level based on the low level signal at the second node N2 and the high level signal at the second constant potential terminal VGH. The first input unit 1 provides a high level to the first node N1 based on the low level signal at the second node N2, a low level signal at the second clock signal terminal XCK and the high level signal at the output signal terminal OUT.

With the above connection of the shift register according to this embodiment, it can be seen from the above description of the operation process of the shift register that the switching of the output signal from the output signal terminal OUT between the high level and the low level occurs during the transition from the first phase t1 to the second phase t2 and the transition from the second phase t2 to the third phase t3. It can be seen from the above analysis that, in the phase t1, the output signal from the output signal terminal OUT will not affect the potential at the first node N1 due to the high level signal provided at the second clock signal terminal XCK and, in the phase t2, for the same reason, the output signal from the output signal terminal OUT will not affect the potential at the first node N1 due to the high level at the second node N2. Accordingly, during the transition from the first phase t1 to the second phase t2, the output signal from the output signal terminal OUT will not affect the potential at the first node N1, thereby avoiding output errors that may otherwise be caused by a change in the potential at the first node N1. In the rest of the operation process, the output signal from the output signal terminal OUT is maintained at the high level, without switching between the high level and the low level. Accordingly, the potential at the first node N1 can be maintained stable, such that the accuracy of the output signal from the shift register can be improved.

In an example, the above input signal terminal IN is configured to receive an input signal, the first constant potential terminal VGL is configured to receive a first constant potential signal and the second constant potential terminal VGH is configured to receive a second constant potential signal. A potential of the first constant potential signal is lower than that of the second constant potential signal.

Figure 4:
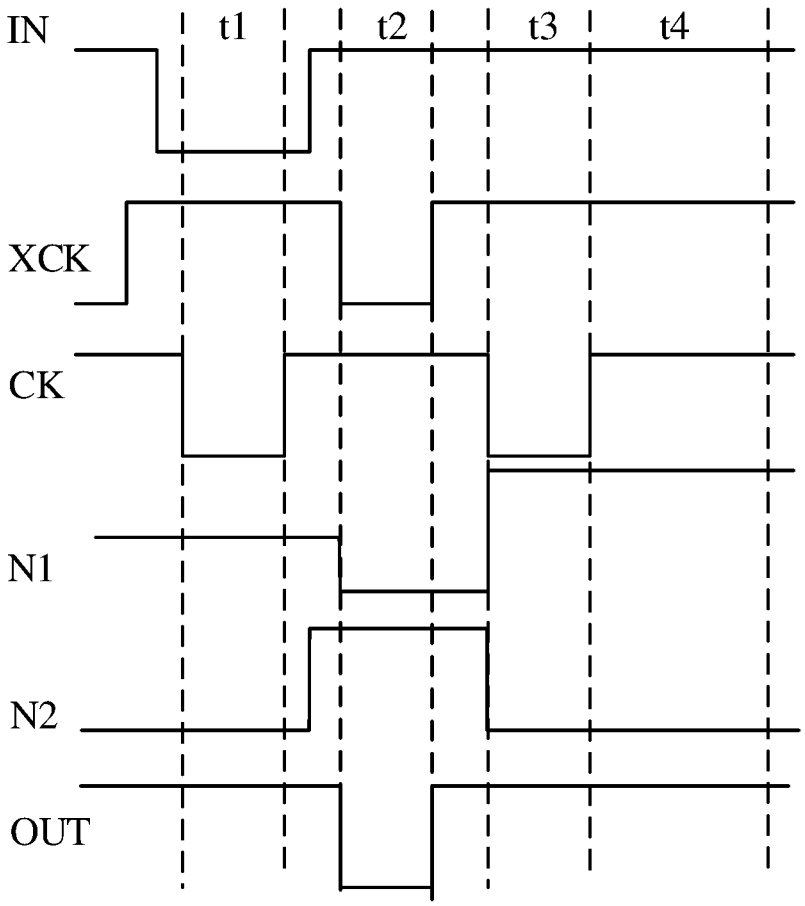
FIG. 4 is a schematic diagram showing an operation timing sequence of a shift register according to an embodiment of the present disclosure.

As shown in FIG. 4, the signal at the first clock signal terminal CK and the signal at the second clock signal terminal XCK are both pulse signals. When the signal at the first clock signal terminal CK is at a low level, the signal at the second clock signal terminal XCK is at a high level. When the signal at the second clock signal terminal XCK is at a low level, the signal at the first clock signal terminal CK is at a high level.

In the following, examples of circuit structures of the first input unit 1, the second input unit 2 and the output unit 3 of the shift register according to this embodiment will be described in detail with reference to FIG. 3.

The first input unit 1 includes a first transistor M1, a second transistor M2, a third transistor M3, a fourth transistor M4 and a fifth transistor M5.

The first transistor M1 and the fourth transistor M4 have their respective control terminals both connected to the first clock signal terminal CK. The first transistor M1 has a first terminal connected to the input signal terminal IN and a second terminal connected to a first terminal of the second transistor M2.

The second transistor M2 and the fifth transistor M5 have their respective control terminals both connected to the second clock signal terminal XCK, and the second transistor M2 has a second terminal connected to a first terminal of the third transistor M3.

The third transistor M3 has a control terminal connected to the second node N2 and a second node connected to the output signal terminal OUT.

The fourth transistor M4 has a first terminal connected to a second terminal of the first transistor M1 and a second terminal connected to the first node N1.

The fifth transistor M5 has a first terminal connected to the second terminal of the first transistor M1 and a second terminal connected to the first node N1.

It is to be noted that, in this embodiment, the above first transistor M1, second transistor M2, third transistor M3, fourth transistor M4 and fifth transistor M5 can be PMOS transistors, each of which is switched on when its control terminal is at a low level and off when its control terminal is at a high level. Unless indicated otherwise, all transistors described hereinafter in this embodiment can be PMOS transistors.

The second input unit 2 includes a sixth transistor M6 and a seventh transistor M7. The sixth transistor M6 has a control terminal connected to the first clock signal terminal CK, a first terminal connected to the first constant potential terminal VGL and a second terminal connected to the second node N2. The seventh transistor M7 has a control terminal connected to the first node N1, a first terminal connected to the input signal terminal IN and a second terminal connected to the second node N2.

The output unit 3 includes an eighth transistor M8 and a ninth transistor M9. The eighth transistor M8 has a control terminal connected to the first node N1, a first terminal connected to the second clock signal terminal XCK and a second terminal connected to the output signal terminal OUT. The ninth transistor M9 has a control terminal connected to the second node N2, a first terminal connected to the second constant potential terminal VGH and a second terminal connected to the output signal terminal OUT.

As shown in FIG. 3, the above shift register further includes a first capacitor C1 and a second capacitor C2. The capacitor C1 has a first electrode connected to the first node N1 and a second electrode connected to the output signal terminal OUT. When the first node N1 is floated, with a coupling effect of the first capacitor C1, the first node N1 can be maintained at its potential in the previous phase. The second capacitor C2 has a first electrode connected to the second node N2 and a second electrode connected to the second constant potential terminal VGH. When the second node N2 is floated, with a coupling effect of the second capacitor C2, the second node N2 can be maintained at its potential in the previous phase.

In the following, the operation process of the above shift register will be described with reference to FIGS. 3 and 4.

In the first phase t1, a low level is provided at the first clock signal terminal CK, such that the first transistor M1, the fourth transistor M4 and the sixth transistor M6 are switched on. A low level is provided at the input signal terminal IN, causing the potential at the first node N1 to be low via the first transistor M1 and the fourth transistor M4 which are on, such that the seventh transistor M7 and the eighth transistor M8 are switched on. The low level provided at the input signal terminal IN causes the potential at the second node N2 to be low via the seventh transistor M7 which is on. A low level provided at the first constant potential terminal VGL causes the potential at the second node N2 to be low via the sixth transistor M6 which is on, such that the third transistor M3 and the ninth transistor M9 are switched on. A high level provided at the second constant potential terminal VGH causes the output signal terminal OUT to output a high level via the ninth transistor M9 which is on. A high level is provided at the second clock signal terminal XCK, causing the output signal terminal OUT to output a high level stably via the eighth transistor M8 which is on. In this phase, the second transistor M2 and the fifth transistor M5 are off and thus the output signal from the output signal terminal OUT will not affect the potential at the first node N1.

In the second phase t2, a high level is provided at the first clock signal terminal CK, such that the first transistor M1, the fourth transistor M4 and the sixth transistor M6 are switched off. With the coupling effect of the first capacitor C1, the first node N1 is maintained at the low potential in the first phase t1, such that the seventh transistor M7 and the eighth transistor M8 are on. A high level is provided at the input signal terminal IN, causing the potential at the second node N2 to be high via the seventh transistor M7 which is on, such that the third transistor M3 and the ninth transistor M9 are switched off. A low level is provided at the second clock signal terminal XCK, causing the output signal terminal OUT to output a low level stably via the eighth transistor M8 which is on. With the coupling effect of the first capacitor C1, the potential at the first node N1 is further pulled down, such that the signal at the second clock signal terminal XCK can be fully outputted via the eighth transistor M8 which is on. In this phase, the third transistor M3 is off and thus the output signal from the output signal terminal OUT will still not affect the potential at the first node N1.

In the third phase t3, a low level is provided at the first clock signal terminal CK, such that the first transistor M1, the fourth transistor M4 and the sixth transistor M6 are switched on. A high level is provided at the input signal terminal IN, causing the potential at the first node N1 to be high via the first transistor M1 and the fourth transistor M4 which are on, such that the seventh transistor M7 and the eighth transistor M8 are switched off. The low level provided at the first constant potential terminal VGL causes the potential at the second node N2 to be low via the sixth transistor M6 which is on, such that the third transistor M3 and the ninth transistor M9 are switched on. The high level provided at the second constant potential terminal VGH causes the output signal terminal OUT to output a high level via the ninth transistor M9 which is on. In this phase, a high level is provided at the second clock signal terminal XCK, such that the second transistor M2 and the fifth transistor M5 are off and thus the output signal from the output signal terminal OUT will still not affect the potential at the first node N1.

In the fourth phase t4, a high level is provided at the first clock signal terminal CK, such that the first transistor M1, the fourth transistor M4 and the sixth transistor M6 are switched off. With the coupling effect of the second capacitor C2, the second node N2 is maintained at the low potential in the third phase t3, such that the third transistor M3 and the ninth transistor M9 are switched on. The high level provided at the second constant potential terminal VGH causes the output signal terminal OUT to output a high level via the ninth transistor M9 which is on. A low level signal is provided at the second clock signal terminal XCK, such that the second transistor M2 and the fifth transistor M5 are switched on. The high level outputted at the output signal terminal OUT causes the potential at the first node N1 to be high via the third transistor M3, the second transistor M2 and the fifth transistor M5 which are on, such that the seventh transistor M7 and the eighth transistor M8 are off. During the third and fourth phases, the output signal from the output signal terminal OUT is maintained at the high level, which avoids impact on the potential at the first node N1 because the output signal fails to be switched between the high level and the low level timely, such that the accuracy of the output signal from the shift register can be improved.

Further, in this embodiment, the fourth transistor M4 and the fifth transistor M5, which are connected to the first clock signal terminal CK and the second clock signal terminal XCK, respectively, are provided between the first transistor M1 and the first node N1. For the signals at the first clock signal terminal CK and the second clock signal terminal XCK, when the signal at the first clock signal terminal CK is at a low level, the signal at the second clock signal terminal XCK is at a high level, and when the signal at the second clock signal terminal XCK is at a low level, the signal at the first clock signal terminal CK is at a high level. That is, the fourth transistor M4 and the fifth transistor M5 are switched on in a time division manner. In this way, when compared with connecting the second terminal of the first transistor M1 to the first node N1 directly, by connecting the fourth transistor M4 and the fifth transistor M5 to the first transistor M1, when the first node N1 is at a low level, the above connection of this embodiment can raise the potential at the second terminal of the first transistor M1. Accordingly, when the first node N1 is at a low level, a breakdown of the first transistor M1 can be avoided due to excessively high voltage across the control terminal and second terminal of the first transistor M1, such that the stability of the shift register can be improved.

Moreover, for a driving circuit consisting of a plurality of stages of shift registers as described above, when the driving circuit is operating, the shift register at each stage other than the first stage has its input signal terminal IN receiving, as the input signal to the shift register, the output signal from the output signal terminal OUT of the shift register at the previous stage. That is, for a driving circuit consisting of a plurality of stages of shift registers as described above, a start signal only needs to be provided to the input signal terminal IN of the shift register at the first stage. Signals needs to be provided from respective signal resources to the first clock signal terminal CK and the second clock signal terminal XCK, such that the driving circuit can operate normally. In this embodiment, the first terminal of the first transistor M1 and the first terminal of the seventh transistor M7 are both connected to the input signal terminal, such that the number of external signal sources and thus the power consumption required for normal operation of the shift register can be reduced while guaranteeing the normal operation of the shift register.

Figure 5:
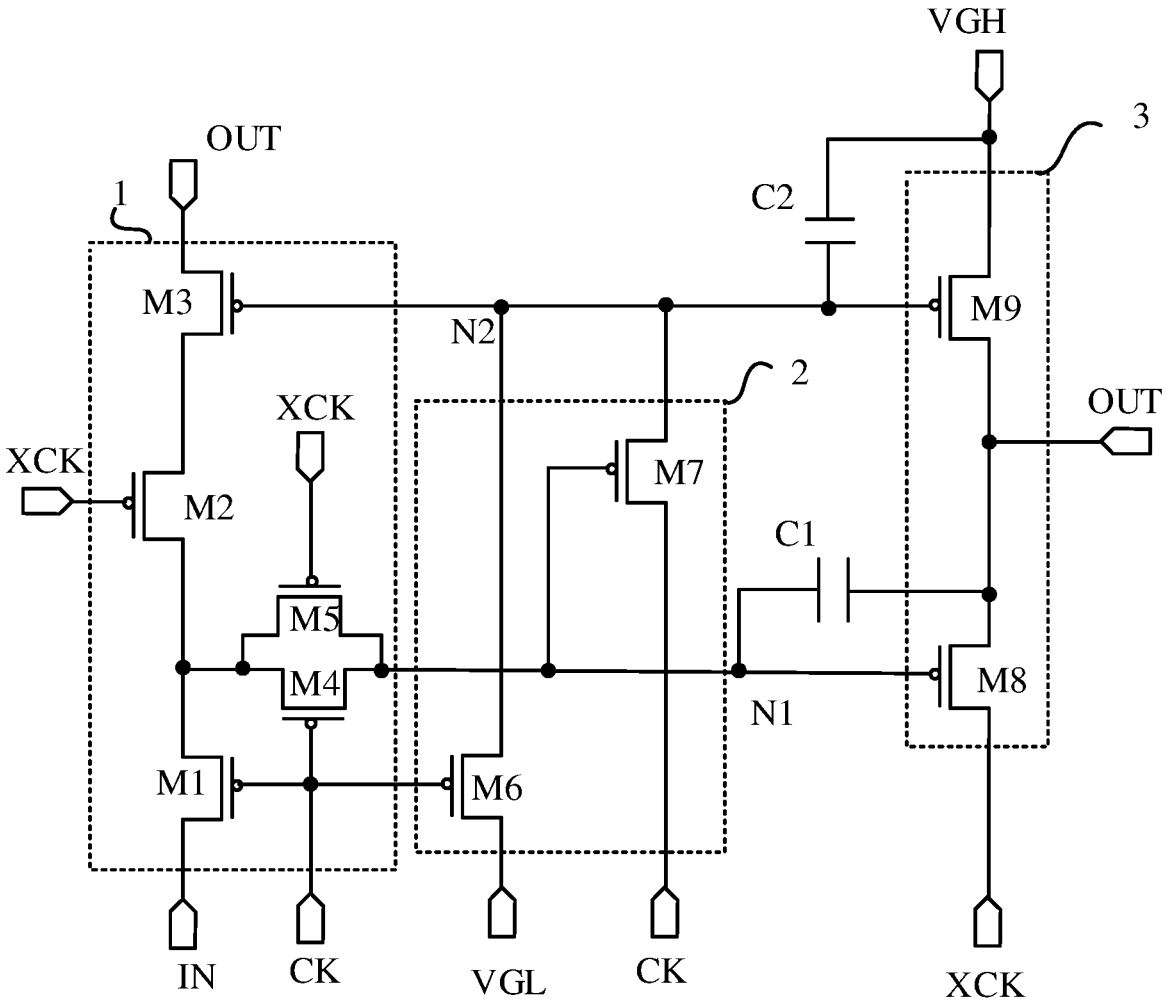
FIG. 5 is a schematic diagram showing a circuit structure of another shift register according to an embodiment of the present disclosure.

In addition to guaranteeing the normal operation of the shift register, a shift register is provided according to an embodiment of the present disclosure. FIG. 5 is a schematic diagram showing an internal structure of another shift register according to an embodiment of the present disclosure. As shown in FIG. 5, the first terminal of the seventh transistor M7 is connected to the first clock signal terminal CK. The connections of the other transistors are the same as those described in connection with the embodiment shown in FIG. 3 and the description thereof will be omitted here.

Referring to FIG. 4 since the control terminal of the seventh transistor M7 is connected to the first node N1 in this embodiment, it can be seen from the above description of the driving process of the shift register that, in the first phase t1 and the second phase t2, the first node N1 is at a low level and the seventh transistor M7 is on. In the first phase t1 and the second phase t2, the signal provided at the first clock signal terminal CK is the same as the signal provided at the input signal terminal IN. Hence, the driving process for the embodiment shown in FIG. 5 is the same as that for the embodiment shown in FIG. 3 and the description thereof will be omitted here.

A driving method is also provided according to an embodiment of the present disclosure. The driving method is applied to the above shift register. Referring to FIG. 4, the operation process of the shift register includes a first phase t1, a second phase t2, a third phase t3 and a fourth phase t4.

In the first phase t1, a first level signal is provided to the input signal terminal IN, the first level signal is provided to the first clock signal terminal CK and a second level signal is provided to the second clock signal terminal XCK, such that the second level signal is outputted at the output signal terminal OUT.

In the second phase t2, the second level signal is provided to the input signal terminal IN, the second level signal is provided to the first clock signal terminal CK and the first level signal to the second clock signal terminal XCK, such that the first level signal is outputted at the output signal terminal OUT.

In the third phase t3, the second level signal is provided to the input signal terminal IN, the first level signal is provided to the first clock signal terminal CK and the second level signal is provided to the second clock signal terminal XCK, such that the second level signal is outputted at the output signal terminal OUT.

In the fourth phase t4, the second level signal is provided to the input signal terminal IN, the second level signal is provided to the first clock signal terminal CK and the first level signal is provided to the second clock signal terminal XCK, such that the second level signal is outputted at the output signal terminal OUT.

The driving process of the shift register has been described in connection with the above embodiment and the description thereof will be omitted here.

With the driving method according to this embodiment, the switching of the output signal from the output signal terminal OUT between the high level and the low level occurs during the transition from the first phase t1 to the second phase t2 and the transition from the second phase t2 to the third phase t3. It can be seen from the above analysis regarding the operation process of the shift register that, in the phase t1, the output signal from the output signal terminal OUT will not affect the potential at the first node N1 due to the high level signal provided at the second clock signal terminal XCK and, in the phase t2, for the same reason, the output signal from the output signal terminal OUT will not affect the potential at the first node N1 due to the high level at the second node N2. Accordingly, during the transition from the first phase t1 to the second phase t2, the output signal from the output signal terminal OUT will not affect the potential at the first node N1, thereby avoiding output errors that may otherwise be caused by a change in the potential at the first node N1. In the rest of the operation process, the output signal from the output signal terminal OUT is maintained at the high level, without switching between the high level and the low level. Accordingly, the potential at the first node N1 can be maintained stable, such that the accuracy of the output signal from the shift register can be improved.

Figure 6:
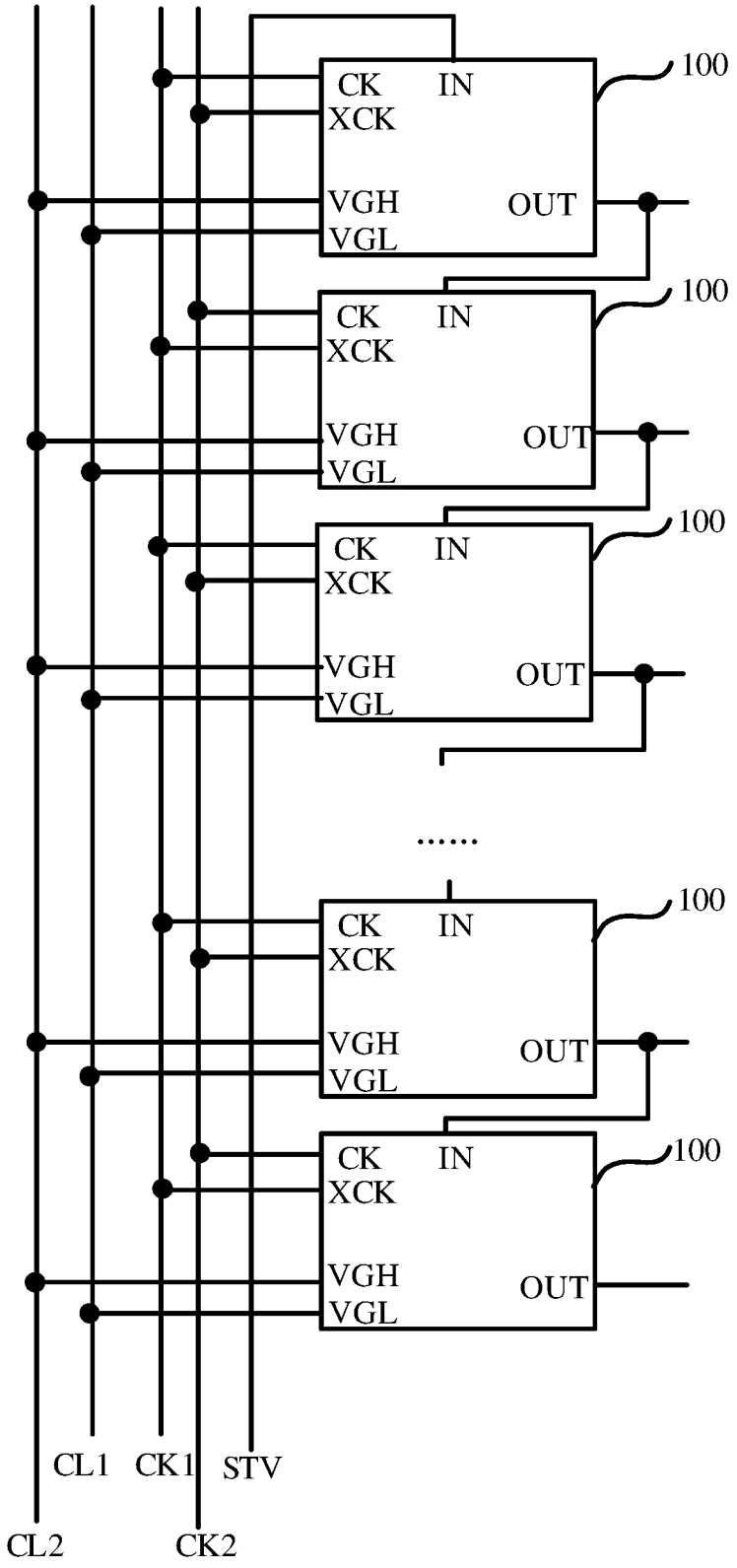
FIG. 6 is a schematic diagram showing a driving circuit according to an embodiment of the present disclosure.

A driving circuit is provided according to an embodiment of the present disclosure. FIG. 6 is a schematic diagram showing a driving circuit according to an embodiment of the present disclosure. As shown in FIG. 6, the driving circuit includes a plurality of cascaded shift registers 100 as described above. The input signal terminal IN of the shift register 100 at the first stage is connected to a start signal terminal STY. The input signal terminal IN of the shift register 100 at each stage other than the first stage is connected to the output signal terminal OUT of the shift register 100 at its previous stage. The first clock signal terminal CK of the shift register 100 at each odd numbered stage is configured to receive the first clock signal CK1 and the second clock signal terminal XCK of the shift register at each odd numbered stage is configured to receive the second clock signal CK2. The first clock signal terminal CK of the shift register at each even numbered stage is configured to receive the second clock signal CK2 and the second clock signal terminal XCK of the shift register at each even numbered stage is configured to receive the first clock signal CK1. The first clock signal CK1 and the second clock signal CK2 are both pulse signals. When the first clock signal CK1 is at a low level, the second clock signal CK2 is at a high level. When the second clock signal CK2 is at a low level, the first clock signal CK1 is at a high level.

Further, as shown in FIG. 6, in the driving circuit, the first constant potential terminal VGL of the shift register 100 at each stage can be connected to a driving chip (not shown) via a first voltage signal line CL1 and the second constant potential terminal VGH of the shift register 100 at each stage can be connected to the driving chip via a second voltage signal line CL2.

The driving circuit according to this embodiment includes a plurality of cascaded shift registers as described above. Hence, with this driving circuit, the switching of the output signal from the output signal terminal OUT between the high level and the low level occurs during the transition from the first phase t1 to the second phase t2 and the transition from the second phase t2 to the third phase t3. It can be seen from the above analysis that, in the phase t1, the output signal from the output signal terminal OUT will not affect the potential at the first node N1 due to the high level signal provided at the second clock signal terminal XCK and, in the phase t2, for the same reason, the output signal from the output signal terminal OUT will not affect the potential at the first node N1 due to the high level at the second node N2. Accordingly, during the transition from the first phase t1 to the second phase t2, the output signal from the output signal terminal OUT will not affect the potential at the first node N1, thereby avoiding output errors that may otherwise be caused by a change in the potential at the first node N1. In the rest of the operation process, the output signal from the output signal terminal OUT is maintained at the high level, without switching between the high level and the low level. Accordingly, the potential at the first node N1 can be maintained stable, such that the accuracy of the output signal from the shift register can be improved.

Figure 7:
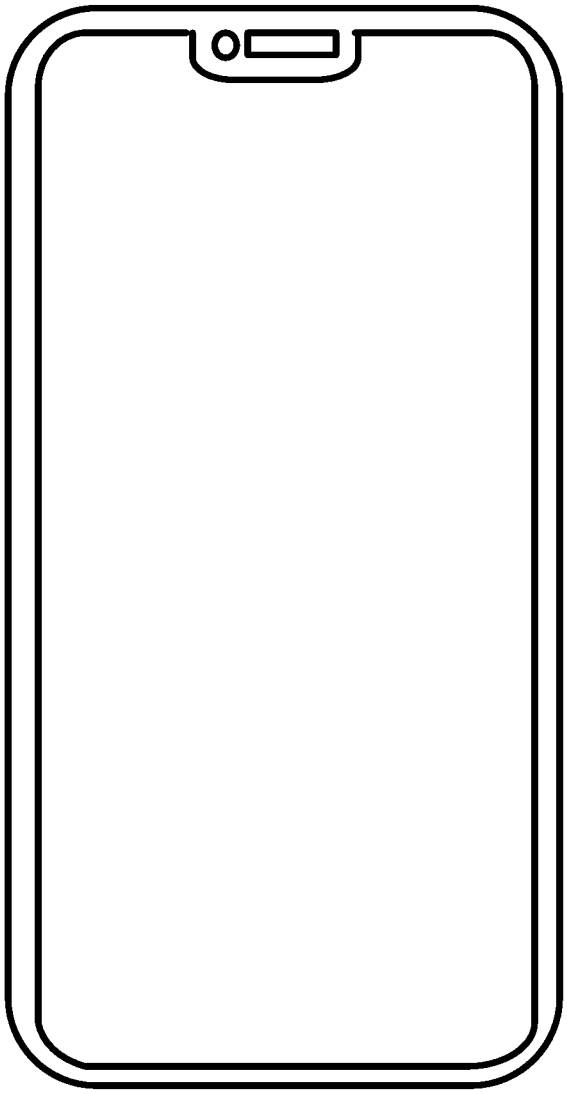
FIG. 7 is a schematic diagram showing a display device according to an embodiment of the present disclosure.

According to an embodiment of the present disclosure, a display device is provided. As shown in FIG. 7, which is a schematic diagram showing a structure of a display device according to an embodiment of the present disclosure, the display device includes the above driving circuit. The structure of the driving circuit has been described in detail in connection with the above embodiments and details thereof will be omitted here. Of course, the display device shown in FIG. 7 is illustrative only. The display device can be any electronic device having a display function, e.g., a mobile phone, a tablet computer, a notebook computer, an e-paper device or a television.

The display device according to this embodiment includes the above driving circuit. Hence, with the display device, due to the above connection of the shift register according to this embodiment, it can be seen from the above description of the operation process of the shift register that the switching of the output signal from the output signal terminal OUT between the high level and the low level occurs during the transition from the first phase t1 to the second phase t2 and the transition from the second phase t2 to the third phase t3. It can be seen from the above analysis regarding the operation process of the shift register that, in the phase t1, the output signal from the output signal terminal OUT will not affect the potential at the first node N1 due to the high level signal provided at the second clock signal terminal XCK and, in the phase t2, for the same reason, the output signal from the output signal terminal OUT will not affect the potential at the first node N1 due to the high level at the second node N2. Accordingly, during the transition from the first phase t1 to the second phase t2, the output signal from the output signal terminal OUT will not affect the potential at the first node N1, thereby avoiding output errors that may otherwise be caused by a change in the potential at the first node N1. In the rest of the operation process, the output signal from the output signal terminal OUT is maintained at the high level, without switching between the high level and the low level. Accordingly, the potential at the first node N1 can be maintained stable, such that the accuracy of the output signal from the shift register can be improved.

It can be appreciated that, in practice, the above display device according to this embodiment can be an Organic Light Emitting Display (OLED) or a Liquid Crystal Display (LCD).

In an OLED, there are typically a plurality of organic light emitting diodes and pixel compensation circuits connected to the respective organic light emitting diodes. Typically, in a pixel compensation circuit, a light emission control transistor for controlling an organic light emitting diode to emit light and a scan control transistor for controlling a data signal input are provided. In practice, when the above display device according to the embodiment of the present disclosure is an OLED, the OLED can include the above driving circuit according to the embodiment of the present disclosure. The driving circuit can serve as a light emission driving circuit for providing the light emission control transistor with a light control signal. Alternatively, the driving circuit can serve as a gate driving circuit for providing the scan control transistor with a scan signal. Of course, the OLED can alternatively include two driving circuits according to the embodiments of the present disclosure, one as a light emission driving circuit and one as a gate driving circuit. The present disclosure is not limited to any of these specific implementations.

In an LCD, there are typically a plurality of pixel electrodes and switching transistors connected to the respective pixel electrodes. In practice, when the above display device according to the embodiment of the present disclosure is an LCD, the above driving circuit according to the embodiment of the present disclosure can serve as a gate driving circuit for providing a switching transistor with a scan signal.

While the preferred embodiments of the present disclosure have been described above, the scope of the present disclosure is not limited thereto. Various modifications, equivalent alternatives or improvements can be made by those skilled in the art without departing from the scope of the present disclosure. These modifications, equivalent alternatives and improvements are to be encompassed by the scope of the present disclosure.

What is claimed is:

1. A driving circuit, comprising one or more shift registers, wherein each of the one or more shift registers comprises:

a first input unit configured to provide a signal at an input signal terminal to a first node under control of a first clock signal terminal; provide the signal at the input signal terminal to the first node under control of the first clock signal terminal and a second clock signal terminal; provide a signal at an output signal terminal to the first node under control of a second node and the second clock signal terminal; and provide the signal at the output signal terminal to the first node under control of the second node, the second clock signal terminal and the first clock signal terminal;

a second input unit configured to provide a signal at a first constant potential terminal to the second node under control of the first clock signal terminal and provide the signal at the input signal terminal or a signal at the first clock signal terminal to the second node under control of the first node; and an output unit configured to provide a signal at the second clock signal terminal to the output signal terminal under control of the signal at the first node and provide a signal at a second constant potential terminal to the output signal terminal under control of the signal at the second node, wherein the output unit comprises an eighth transistor and a ninth transistor, wherein the eighth transistor has a control terminal connected to the first node, a first terminal connected to the second clock signal terminal and a second terminal connected to the output signal terminal, and the ninth transistor has a control terminal connected to the second node, a first terminal connected to the second constant potential terminal and a second terminal connected to the output signal terminal.

2. The driving circuit according to claim 1, wherein the input signal terminal is configured to receive an input signal, the first constant potential terminal is configured to receive a first constant potential signal and the second constant potential terminal is configured to receive a second constant potential signal, a potential of the first constant potential signal being lower than that of the second constant potential signal, the signal at the first clock signal terminal and the signal at the second clock signal terminal are both pulse signals, when the signal at the first clock signal terminal is at a low level, the signal at the second clock signal terminal is at a high level, and when the signal at the second clock signal terminal is at a low level, the signal at the first clock signal terminal is at a high level.

3. The driving circuit according to claim 1, wherein the first input unit comprises a first transistor, a second transistor, a third transistor, a fourth transistor and a fifth transistor, wherein the first transistor has a control terminal connected to the first clock signal terminal, a first terminal connected to the input signal terminal and a second terminal, the second transistor has a control terminal connected to the second clock signal terminal, a first terminal connected to the second terminal of the first transistor and a second terminal, the third transistor has a control terminal connected to the second node, a first terminal connected to the second terminal of the second transistor and a second terminal connected to the output signal terminal, the fourth transistor has a control terminal connected to the first clock signal terminal, a first terminal connected to the second terminal of the first transistor and a second terminal connected to the first node, and the fifth transistor has a control terminal connected to the second clock signal terminal, a first terminal connected to the second terminal of the first transistor and a second terminal connected to the first node.

4. The driving circuit according to claim 1, wherein the second input unit comprises a sixth transistor and a seventh transistor, wherein the sixth transistor has a control terminal connected to the first clock signal terminal, a first terminal connected to the first constant potential terminal and a second terminal connected to the second node, and the seventh transistor has a control terminal connected to the first node, a first terminal connected to the input signal terminal or the first clock signal terminal, and a second terminal connected to the second node.

5. The driving circuit according to claim 1, further comprising:

a first capacitor having a first electrode connected to the first node and a second electrode connected to the output signal terminal; and a second capacitor having a first electrode connected to the second node and a second electrode connected to the second constant potential terminal.

6. The driving circuit according to claim 1, wherein the one or more shift registers comprise a plurality of shift registers, and the plurality of shift registers are cascaded, wherein the input signal terminal of the shift register at the first stage of the plurality of shift registers is connected to a start signal terminal, and the input signal terminal of the shift register at each stage other than the first stage of the plurality of shift registers is connected to the output signal terminal of the shift register at its previous stage, the first clock signal terminal of the shift register at each odd numbered stage of the plurality of shift registers is configured to receive a first clock signal, and the second clock signal terminal of the shift register at each odd numbered stage of the plurality of shift registers is configured to receive a second clock signal, the first clock signal terminal of the shift register at each even numbered stage of the plurality of shift registers is configured to receive the second clock signal, and the second clock signal terminal of the shift register at each even numbered stage of the plurality of shift registers is configured to receive the first clock signal, when the first clock signal is at a low level, the second clock signal is at a high level, and when the second clock signal is at a low level, the first clock signal is at a high level.

7. A display device, comprising a driving circuit, wherein the driving circuit comprises one or more shift registers, and each of the one or more shift registers comprises:

a first input unit configured to provide a signal at an input signal terminal to a first node under control of a first clock signal terminal; provide the signal at the input signal terminal to the first node under control of the first clock signal terminal and a second clock signal terminal; provide a signal at an output signal terminal to the first node under control of a second node and the second clock signal terminal; and provide the signal at the output signal terminal to the first node under control of the second node, the second clock signal terminal and the first clock signal terminal;

a second input unit configured to provide a signal at a first constant potential terminal to the second node under control of the first clock signal terminal and provide the signal at the input signal terminal or a signal at the first clock signal terminal to the second node under control of the first node; and an output unit configured to provide a signal at the second clock signal terminal to the output signal terminal under control of the signal at the first node and provide a signal at a second constant potential terminal to the output signal terminal under control of the signal at the second node, wherein the output unit comprises an eighth transistor and a ninth transistor, wherein the eighth transistor has a control terminal connected to the first node, a first terminal connected to the second clock signal terminal and a second terminal connected to the output signal terminal, and the ninth transistor has a control terminal connected to the second node, a first terminal connected to the second constant potential terminal and a second terminal connected to the output signal terminal.

8. The display device according to claim 7, wherein the input signal terminal is configured to receive an input signal, the first constant potential terminal is configured to receive a first constant potential signal and the second constant potential terminal is configured to receive a second constant potential signal, a potential of the first constant potential signal being lower than that of the second constant potential signal, the signal at the first clock signal terminal and the signal at the second clock signal terminal are both pulse signals, when the signal at the first clock signal terminal is at a low level, the signal at the second clock signal terminal is at a high level, and when the signal at the second clock signal terminal is at a low level, the signal at the first clock signal terminal is at a high level.

9. The display device according to claim 7, wherein the first input unit comprises a first transistor, a second transistor, a third transistor, a fourth transistor and a fifth transistor, wherein the first transistor has a control terminal connected to the first clock signal terminal, a first terminal connected to the input signal terminal and a second terminal, the second transistor has a control terminal connected to the second clock signal terminal, a first terminal connected to the second terminal of the first transistor and a second terminal, the third transistor has a control terminal connected to the second node, a first terminal connected to the second terminal of the second transistor and a second terminal connected to the output signal terminal, the fourth transistor has a control terminal connected to the first clock signal terminal, a first terminal connected to the second terminal of the first transistor and a second terminal connected to the first node, and the fifth transistor has a control terminal connected to the second clock signal terminal, a first terminal connected to the second terminal of the first transistor and a second terminal connected to the first node.

10. The display device according to claim 7, wherein the second input unit comprises a sixth transistor and a seventh transistor, wherein the sixth transistor has a control terminal connected to the first clock signal terminal, a first terminal connected to the first constant potential terminal and a second terminal connected to the second node, and the seventh transistor has a control terminal connected to the first node, a first terminal connected to the input signal terminal or the first clock signal terminal, and a second terminal connected to the second node.

11. The display device according to claim 7, further comprising:

a first capacitor having a first electrode connected to the first node and a second electrode connected to the output signal terminal; and a second capacitor having a first electrode connected to the second node and a second electrode connected to the second constant potential terminal.

12. The display device according to claim 7, wherein the one or more shift registers comprise a plurality of shift registers, and the plurality of shift registers are cascaded, wherein the input signal terminal of the shift register at the first stage of the plurality of shift registers is connected to a start signal terminal, and the input signal terminal of the shift register at each stage other than the first stage of the plurality of shift registers is connected to the output signal terminal of the shift register at its previous stage, the first clock signal terminal of the shift register at each odd numbered stage of the plurality of shift registers is configured to receive a first clock signal, and the second clock signal terminal of the shift register at each odd numbered stage of the plurality of shift registers is configured to receive a second clock signal, the first clock signal terminal of the shift register at each even numbered stage of the plurality of shift registers is configured to receive the second clock signal, and the second clock signal terminal of the shift register at each even numbered stage of the plurality of shift registers is configured to receive the first clock signal, when the first clock signal is at a low level, the second clock signal is at a high level, and when the second clock signal is at a low level, the first clock signal is at a high level.

13. A driving method, applied in a driving circuit, wherein the driving circuit comprises one or more shift registers, and each of the one or more shift registers comprises:

a first input unit configured to provide a signal at an input signal terminal to a first node under control of a first clock signal terminal; provide the signal at the input signal terminal to the first node under control of the first clock signal terminal and a second clock signal terminal; provide a signal at an output signal terminal to the first node under control of a second node and the second clock signal terminal; and provide the signal at the output signal terminal to the first node under control of the second node, the second clock signal terminal and the first clock signal terminal;

a second input unit configured to provide a signal at a first constant potential terminal to the second node under control of the first clock signal terminal and provide the signal at the input signal terminal or a signal at the first clock signal terminal to the second node under control of the first node; and an output unit configured to provide a signal at the second clock signal terminal to the output signal terminal under control of the signal at the first node and provide a signal at a second constant potential terminal to the output signal terminal under control of the signal at the second node, wherein the driving method comprises:

in a first phase, providing a first level signal to the input signal terminal, the first level signal to the first clock signal terminal and a second level signal to the second clock signal terminal, such that the second level signal is outputted at the output signal terminal;

in a second phase, providing the second level signal to the input signal terminal, the second level signal to the first clock signal terminal and the first level signal to the second clock signal terminal, such that the first level signal is outputted at the output signal terminal;

in a third phase, providing the second level signal to the input signal terminal, the first level signal to the first clock signal terminal and the second level signal to the second clock signal terminal, such that the second level signal is outputted at the output signal terminal; and in a fourth phase, providing the second level signal to the input signal terminal, the second level signal to the first clock signal terminal and the first level signal to the second clock signal terminal, such that the second level signal is outputted at the output signal terminal.

14. The driving method according to claim 13, wherein the input signal terminal is configured to receive an input signal, the first constant potential terminal is configured to receive a first constant potential signal and the second constant potential terminal is configured to receive a second constant potential signal, a potential of the first constant potential signal being lower than that of the second constant potential signal, the signal at the first clock signal terminal and the signal at the second clock signal terminal are both pulse signals, when the signal at the first clock signal terminal is at a low level, the signal at the second clock signal terminal is at a high level, and when the signal at the second clock signal terminal is at a low level, the signal at the first clock signal terminal is at a high level.

15. The driving method according to claim 13, wherein the first input unit comprises a first transistor, a second transistor, a third transistor, a fourth transistor and a fifth transistor, wherein the first transistor has a control terminal connected to the first clock signal terminal, a first terminal connected to the input signal terminal and a second terminal, the second transistor has a control terminal connected to the second clock signal terminal, a first terminal connected to the second terminal of the first transistor and a second terminal, the third transistor has a control terminal connected to the second node, a first terminal connected to the second terminal of the second transistor and a second terminal connected to the output signal terminal, the fourth transistor has a control terminal connected to the first clock signal terminal, a first terminal connected to the second terminal of the first transistor and a second terminal connected to the first node, and the fifth transistor has a control terminal connected to the second clock signal terminal, a first terminal connected to the second terminal of the first transistor and a second terminal connected to the first node.

16. The driving method according to claim 13, wherein the second input unit comprises a sixth transistor and a seventh transistor, wherein the sixth transistor has a control terminal connected to the first clock signal terminal, a first terminal connected to the first constant potential terminal and a second terminal connected to the second node, and the seventh transistor has a control terminal connected to the first node, a first terminal connected to the input signal terminal or the first clock signal terminal, and a second terminal connected to the second node.

17. The driving method according to claim 13, wherein the output unit comprises an eighth transistor and a ninth transistor, wherein the eighth transistor has a control terminal connected to the first node, a first terminal connected to the second clock signal terminal and a second terminal connected to the output signal terminal, and the ninth transistor has a control terminal connected to the second node, a first terminal connected to the second constant potential terminal and a second terminal connected to the output signal terminal.

18. The driving method according to claim 13, further comprising:

a first capacitor having a first electrode connected to the first node and a second electrode connected to the output signal terminal; and a second capacitor having a first electrode connected to the second node and a second electrode connected to the second constant potential terminal.

* * * * *